US009572411B2

(12) United States Patent
Mertens et al.

(10) Patent No.: US 9,572,411 B2
(45) Date of Patent: Feb. 21, 2017

(54) LUGGAGE ARTICLE WITH EXTERNAL FRAME HAVING RODS JOINED TOGETHER BY CORNER PIECES

(71) Applicant: Samsonite IP Holdings S.ar.l., Luxembourg (LU)

(72) Inventors: Annelies Mertens, Oudenaarde (BE); Reinhard Meersschaert, Merelbeke (BE)

(73) Assignee: Samsonite IP Holdings S.a r.l., Luxembourg (LU)

( * ) Notice: Subject to any disclaimer, the term of this patent is extended or adjusted under 35 U.S.C. 154(b) by 0 days.

(21) Appl. No.: 14/540,156

(22) Filed: Nov. 13, 2014

(65) Prior Publication Data

US 2015/0129384 A1 May 14, 2015

(30) Foreign Application Priority Data

Nov. 13, 2013 (EP) ..... 13192792

(51) Int. Cl.

| | |
|---|---|
| ***A45C 13/36*** | (2006.01) |
| ***A45C 5/14*** | (2006.01) |
| ***A45C 13/04*** | (2006.01) |
| *A45C 5/03* | (2006.01) |

(52) U.S. Cl.

CPC ..... *A45C 13/36* (2013.01); *A45C 5/03* (2013.01); *A45C 5/14* (2013.01); *A45C 13/04* (2013.01); *A45C 2005/035* (2013.01)

(58) Field of Classification Search

CPC ..... A45C 13/04; A45C 13/36
USPC ..... 190/37, 127, 126
See application file for complete search history.

(56) References Cited

U.S. PATENT DOCUMENTS

| | | | | |
|---|---|---|---|---|
| 1,641,871 A * | 9/1927 | Solomon | A45C 3/02 190/119 |
| 2,515,605 A * | 7/1950 | Lifton | A45C 3/02 190/127 |
| 2,689,028 A * | 9/1954 | Hartman | A45C 5/03 190/124 |
| 3,424,178 A * | 1/1969 | Yazaki | A01G 9/16 135/119 |

(Continued)

FOREIGN PATENT DOCUMENTS

| | | |
|---|---|---|
| BE | 488837 A | 5/1949 |
| DE | 202010004883 U1 | 9/2010 |

(Continued)

OTHER PUBLICATIONS

Extended European Search Report of European Patent Application No. 13192792.3, dated Apr. 2, 2014, 5 pages.

*Primary Examiner* — Sue A Weaver
(74) *Attorney, Agent, or Firm* — Dorsey & Whitney LLP

(57) ABSTRACT

A luggage article may include at least one panel attached to other walls to form the luggage article. The at least one panel may be framed by rods and/or a coil spring member connected to corner pieces to form a peripheral frame that extends around and is attached to and supports the periphery of a lamina to thereby form a framed panel that is attached to the other walls to form the luggage article. The configuration of the rods, coil spring member and the corner pieces may result in reduced weight and improved memory and elasticity comparative to conventional frames, and may offer an improvement and alternative to conventional luggage frames.

15 Claims, 8 Drawing Sheets

(56) References Cited

U.S. PATENT DOCUMENTS

| | | | | | |
|---|---|---|---|---|---|
| 3,730,308 | A * | 5/1973 | Pelavin | A45C 3/001 | 190/115 |
| 4,383,142 | A * | 5/1983 | Kaneko | A45C 13/36 | 190/126 |
| 4,784,248 | A * | 11/1988 | Workman | A45C 5/02 | 112/419 |
| 4,813,520 | A | 3/1989 | Lin | | |
| 6,131,713 | A * | 10/2000 | Sher | A45C 5/02 | 190/115 |
| 7,896,143 | B2 * | 3/2011 | Lee | A45C 5/02 | 190/100 |
| 7,984,797 | B1 | 7/2011 | Bieber | | |
| 2002/0081448 | A1 * | 6/2002 | Matsushima | A41D 27/085 | 428/542.2 |
| 2004/0045779 | A1 * | 3/2004 | Chen | A45C 13/36 | 190/37 |
| 2005/0072641 | A1 * | 4/2005 | Chen | A45C 13/36 | 190/37 |
| 2009/0101460 | A1 * | 4/2009 | Justham | A45C 5/03 | 190/16 |
| 2012/0024649 | A1 | 2/2012 | Lai | | |

FOREIGN PATENT DOCUMENTS

| | | | |
|---|---|---|---|
| EP | 2363037 | B1 | 2/2013 |
| FR | 2949950 | A1 | 3/2011 |
| GB | 1558654 | A | 1/1980 |
| GB | 2440206 | B | 6/2009 |
| GB | 2441580 | B | 1/2010 |
| GB | 2477087 | A | 7/2011 |
| WO | 2013/072405 | A1 | 5/2013 |

* cited by examiner

LUGGAGE ARTICLE WITH EXTERNAL FRAME HAVING RODS JOINED TOGETHER BY CORNER PIECES

CROSS REFERENCE TO RELATED APPLICATION

This application claims the benefit of priority to European Patent Application No. 13192792.3, filed Nov. 13, 2013 and entitled "Luggage Article with External Frame Having Rods Joined Together by Corner Pieces", which is hereby incorporated by reference as though fully set forth herein.

TECHNICAL FIELD

The present disclosure relates generally to a luggage article and particularly to a luggage article with an external frame having rods joined together by corner pieces.

BACKGROUND

Soft-sided or hybrid (soft-sided and hard-sided) luggage articles (e.g., suitcases) conventionally include a frame to provide support and rigidity to one or more soft panels or walls of the luggage article. The design of such frames for luggage articles presents a particularly unique challenge. Specifically, the frames must be robust enough to withstand use under heavy loading of the luggage article and impact forces when the luggage article is dropped. On the other hand the frames must also be lightweight and compact so as to maximize the weight and volume that the luggage article can carry for a given overall size and weight. The frames must also be simple and relatively cheap to produce and assemble to minimize cost.

Conventional frames are constructed of steelwire that extends through a sleeve attached to the periphery of a panel of a luggage article. One drawback of the steelwire frame is the steelwire may be susceptible to permanent deformation under heavy loads or high impact forces. Another drawback of the steelwire frame is the steelwire is relatively heavy, and thus increases the weight of the luggage article more than preferred. To overcome some of the issues with a steelwire frame, some luggage articles include internal frames having struts connected together by joint members. A drawback to these internal frames is the frame occupies internal space of the luggage article, and thus the luggage article has less internal space to store one's belongings.

It is therefore desirable to provide an improved luggage article, and more specifically an improved external frame that addresses the above described problems and/or which more generally offers improvements or an alternative to existing arrangements.

Documents that may be related to the present disclosure in that they include various frames are: DE202010004883, EP2363037, FR2949950, GB2440206, GB2441580, GB2477087, PCT/EP2012/072697, and U.S. Pat. No. 7,984,797.

SUMMARY

According to the present disclosure there is therefore provided a luggage article as described in the accompanying claims.

In an embodiment of the invention, a luggage article may include at least one panel attached to other walls to form the luggage article. The at least one panel may be framed by rods connected to corner pieces to form a peripheral frame that extends around and is attached to and supports the periphery of a lamina to thereby form a framed panel that is attached to other walls to form the luggage article. In another embodiment of the invention, a luggage article may include at least one panel framed by rods with corner pieces fitted thereon. The at least one panel is attached to other walls to form the luggage article. The rods may be positioned adjacent to the walls of the luggage article. In another embodiment of the invention, the at least one panel may be framed by a rod being formed by a coil spring member, and other rods with corner pieces fitted thereon. These rods form a peripheral frame which extends around, and is attached to and supports the periphery of a lamina, forming a framed panel. The framed panel is attached to other walls to form the luggage article. Relative to conventional luggage frames, the frame may result in better memory and elasticity with reduced weight. The frame may be easier to twist than conventional luggage frames with reduced permanent deformation, facilitating handling of individual panels or walls of a luggage article and assembly of the individual walls into a luggage article. Additionally, the rods may be positioned external to the walls of the luggage article. The frame may be positioned external to the outer cover of the luggage article, resulting in more internal space for one's belongings.

The at least one panel may comprise a pair of side walls of the luggage article. The at least one panel comprises a front wall of the luggage article. The rods and corner pieces may extend in a closed loop around the periphery of the at least one panel and may form a substantially rectangular shape. The rods and corner pieces may be attached to the at least one panel prior to attachment of the at least one panel to the other walls of the luggage article.

The corner pieces may be attached to the outer cover at a corner region of the at least one panel. The corner pieces may be exposed and provide corner reinforcement to the luggage article. Each corner piece may include at least one end region defining a constrictable receiving cavity adapted to receive an end portion of a respective rod. The at least one end region may include a boss that defines the receiving cavity and include a pair of radially-extending, angularly-spaced tabs attached to opposing, circumferentially-separated edges of the boss. The opposing edges of the boss may be separated from one another by a longitudinally-extending slit, and movement of the tabs towards one another may narrow the slit and constrict the size of the receiving cavity. When the tabs are attached to one another, the boss may apply a radially compressive force to the end portion of the respective rod to secure the corner piece to the respective rod.

The rods may have a radially-projecting, longitudinally-extending ridge that extends between the radially-extending tabs to prevent or substantially prevent rotation of the respective rod relative to the corner pieces. The radially-extending tabs may extend into and may be attached along one or more seams of the luggage article. The corner pieces may include an arcuate, intermediate region having a solid cross-section. The intermediate region may include a fin aligned with the tabs of the at least one end region.

The frame or framed panel may include sleeves positioned around the rods. The sleeves may be attached to lamina or section of material to secure the frame to the lamina. The sleeves may be exposed externally of the luggage article. The sleeves may include longitudinally-extending edge portions that extend into and are attached along one or more seams of the luggage article. The frame members may be positioned internal to the walls of the luggage case, and may or may not be received in sleeves.

The frame, preferably held within the sleeves, may be located externally of a lamina and on the outside of the framed luggage panel and luggage.

This summary of the disclosure is given to aid understanding, and one of skill in the art will understand that each of the various aspects and features of the disclosure may advantageously be used separately in some instances, or in combination with other aspects and features of the disclosure in other instances.

BRIEF DESCRIPTION OF THE DRAWINGS

The present disclosure will now be described by way of example only with reference to the following figures in which.

DETAILED DESCRIPTION

Figure 1:
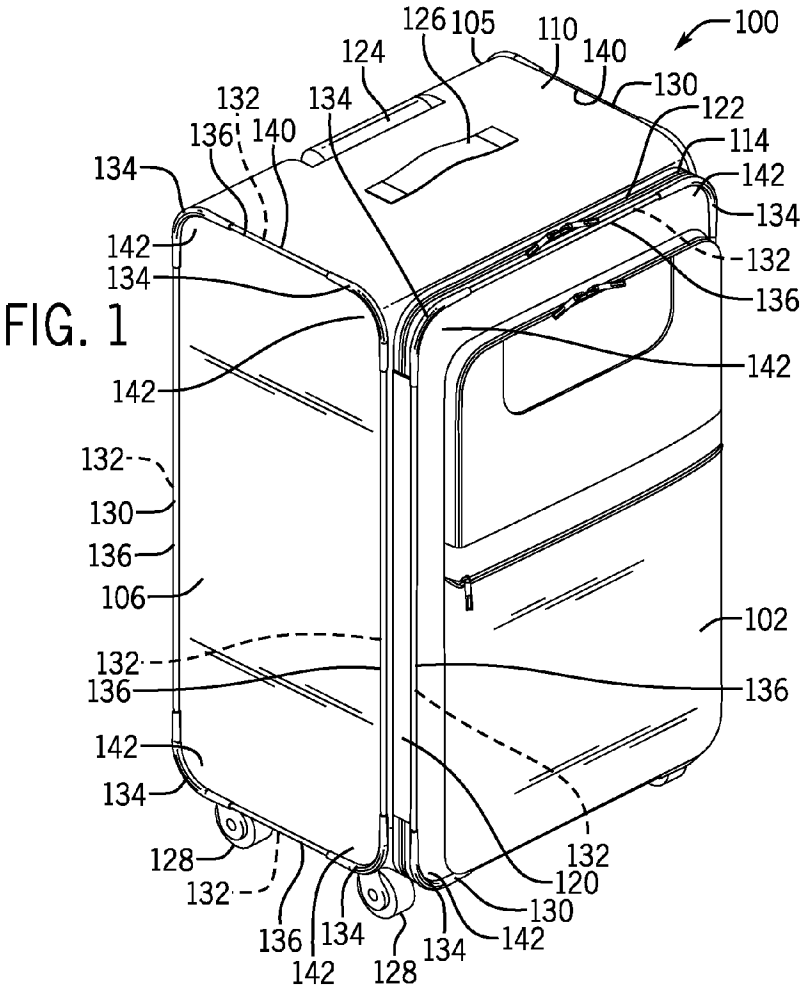
FIG. 1 is a schematic front perspective view of a luggage article according to an embodiment of the invention.
Figure 2:
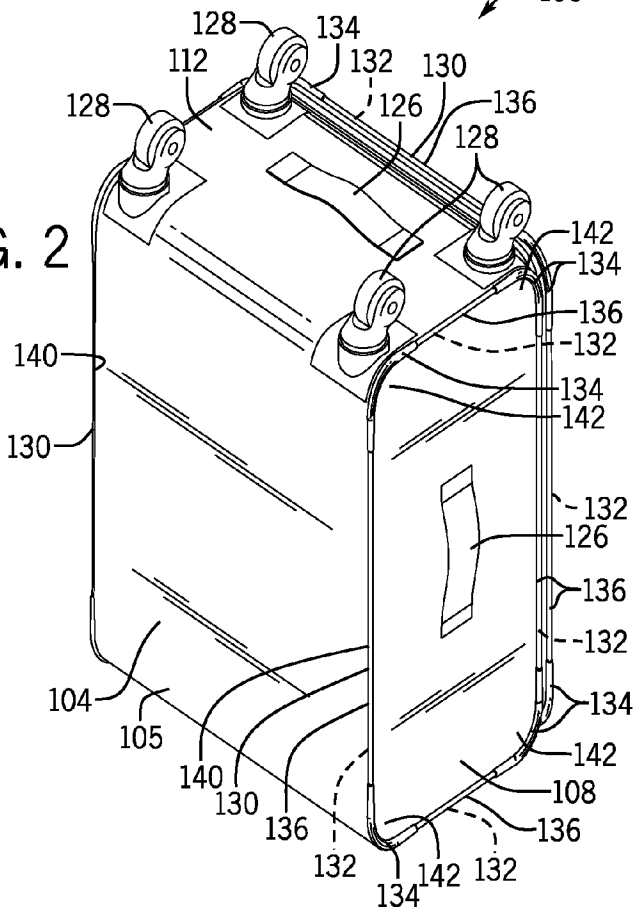
FIG. 2 is a schematic rear perspective view of a luggage article shown in FIG. 1.

Referring to FIGS. 1 and 2, a wheeled luggage article 100 according to an example of the invention includes a plurality of walls 102,104,106,108,110,112 together defining an enclosed internal volume of the luggage article 100 in which to carry a user's belongings. The luggage article 100 includes opposing front and rear walls 102,104, opposing side walls 106,108, and opposing top and bottom end walls 110,112 that collectively define a housing or outer cover 105 of the luggage article 100. The luggage article 100 may be a bag, a case, or other luggage articles. The luggage article 100 may be soft-sided or include both hard and soft sides (hybrid). For soft-sided and hybrid luggage articles, the soft-sided walls may be referred to as panels.

The luggage article 100 may be split along an opening line 114 into a lid section, which includes the front wall 102, and a base section, which includes the rear wall 104. The lid section may be connected to the base section along a portion of a side of the article 100 via a hinge 120 in a conventional manner, and the luggage article 100 may be opened at the opening line 114 to access the internal volume. The hinge 120 may be formed of a zipper 122 and a fabric strip, a piano hinge, discrete hinges spaced apart, or an articulating joint. The piano hinge, the discrete hinges, or the articulating joint may be made from metal, plastic, any other suitable material, or any combination thereof. The hinge 120 may be stitched to the lid and also to the base, or may be coupled in another suitable manner. A zipper 122 along a periphery of the opening line 114 or other conventional closure arrangement, for example clamp locks, may secure the lid section to the base section to close the luggage article 100.

The luggage article 100 may include at least one handle. The depicted luggage article 100 includes a telescoping tow handle 124 associated with the top wall 110. The depicted case also includes fixed carry handles 126 attached to the side wall 108, the top wall 110, and the bottom wall 112. The telescoping handle 124 and the fixed carry handles 126 may be associated with any wall of the luggage article 100.

The luggage article 100 may include at least one wheel assembly 128. The depicted luggage article 100 includes four wheel assemblies 128 mounted from the bottom end wall 112 of the case 110. Each spinner wheel assembly 128 may be located proximate a bottom end corner of the article 100 or any other suitable location to provide stability to the luggage article 100 when in an upright position.

Figure 3:
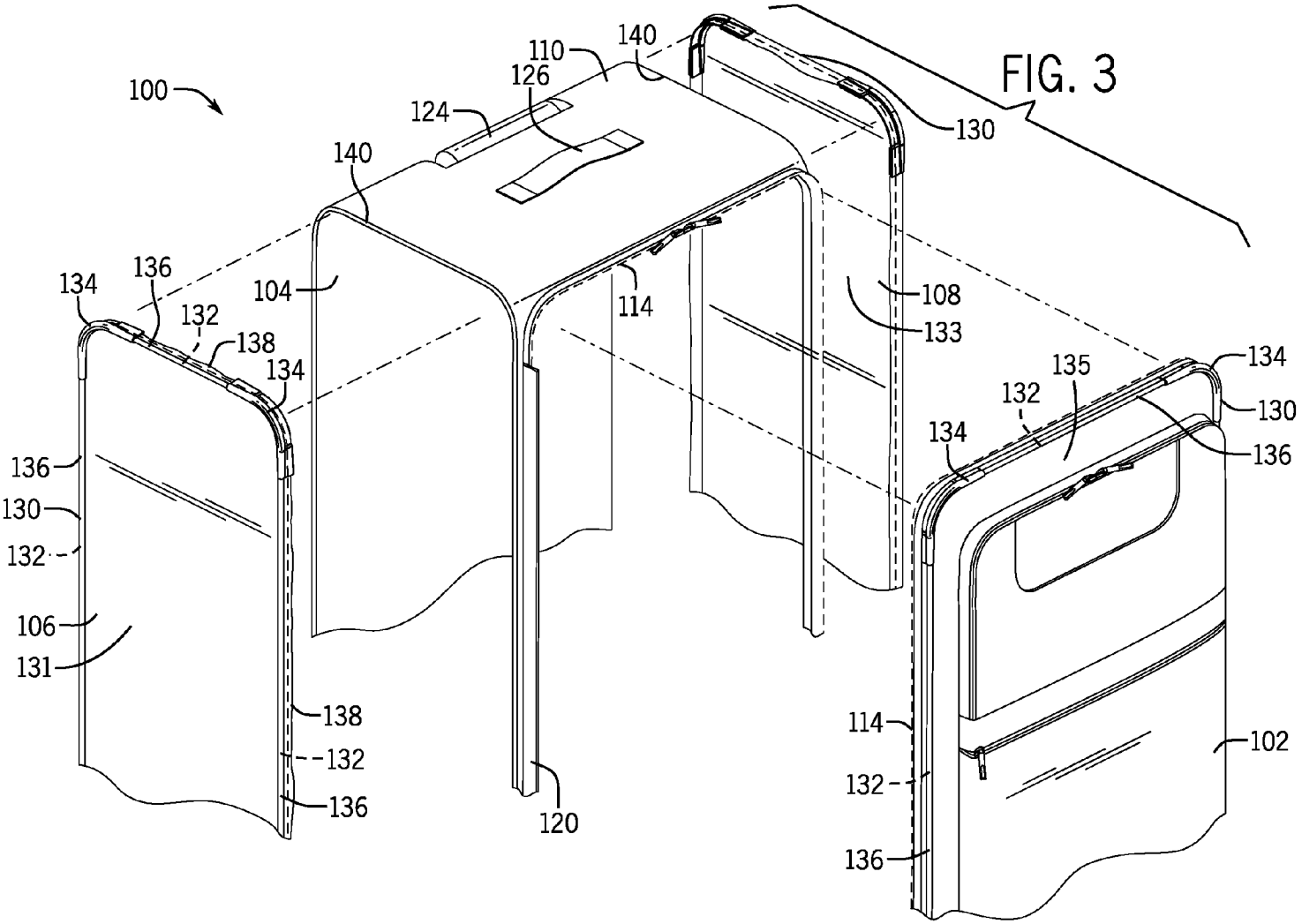
FIG. 3 is a schematic, fragmentary view of an upper portion of a luggage article shown in FIG. 1 exploded along seam lines of the luggage article.

Referring to FIGS. 1-3, the luggage article 100 may include one or more framed panels 102,106,108. The framed panels 102,106,108 are framed by rods 132 connected together by corner pieces 134, which collectively may be referred to as a frame 130. The frames 130 may extend around a periphery of the panels 102,106,108 and may provide rigidity to the panels and corner protection to the luggage article 100. The individual frames 130 may be planar such that the rods 132 and corner pieces 134 are positioned in a common plane. The frames 130 are attached to and hold a lamina or lamina panels 131,133,135, which may be a non-rigid material such as a fabric or other material, to form the framed panels 102,106,108.

Referring to FIG. 3, the luggage article 100 is shown in exploded view. The framed panels 102,106,108 of the luggage article 100 are preferably pre-assembled and provide structural support to the luggage article 100 post-assembly. The luggage article 100 shown in FIG. 3 includes three framed panels: one frame 130 attached to the front panel 102, another frame 130 attached to the side panel 106, and an additional frame 130 attached to the side panel 108. Each frame 130 may extend in a closed loop around the periphery of the respective panel 102,106,108. The frames 130 attached to the side panels 106,108 may serve a dual function of protecting the rear wall 104 as well as the side panels 106,108. Each frame 130 may form a substantially rectangular shape with rounded corners, although the frames 130 may be formed in other suitable shapes, such as trapezoidal. The luggage article 100 may include more or less than three frames 130, and the frames 130 may be attached to any panel or wall of the luggage article 100. The luggage article 100 may include conventional wire loop frames as well as the frames 130. For example, the luggage article 100 may include a front panel 102 framed with frame 130 and other panels framed with a wire loop. For hybrid luggage articles 100, the front panel 102 may include a frame 130, for example.

Referring to FIGS. 1-4A, each frame 130 may include a plurality of elongated frame members or rods 132 joined together by a plurality of corner connectors or pieces 134. The rods 132 may extend in a straight or substantially straight line. The rods 132 may be positioned external to the outer cover 105 and may be concealed or covered by a sheath or sleeve 136. With reference to FIGS. 1-3 and 6A-7, a separate sleeve 136 may be positioned around each pultrusion rod 132 and may be positioned at least partially external to the outer cover 105. Each sleeve 136 may be formed of a single strip of material, such as a fabric, that extends the length of the associated rod 132 and is folded over the rod 132 to form longitudinally-extending edge portions 138 that extend from opposing sides of the rod 132. (see FIGS. 6A and 6B). A portion of the sleeves 136 may be exposed externally of the outer cover 105 and may provide wear protection. The sleeves 136 may be formed of a material that is more wear resistant than the walls 102,104, 106,108,110,112 of the luggage article 100.

Figure 4A:
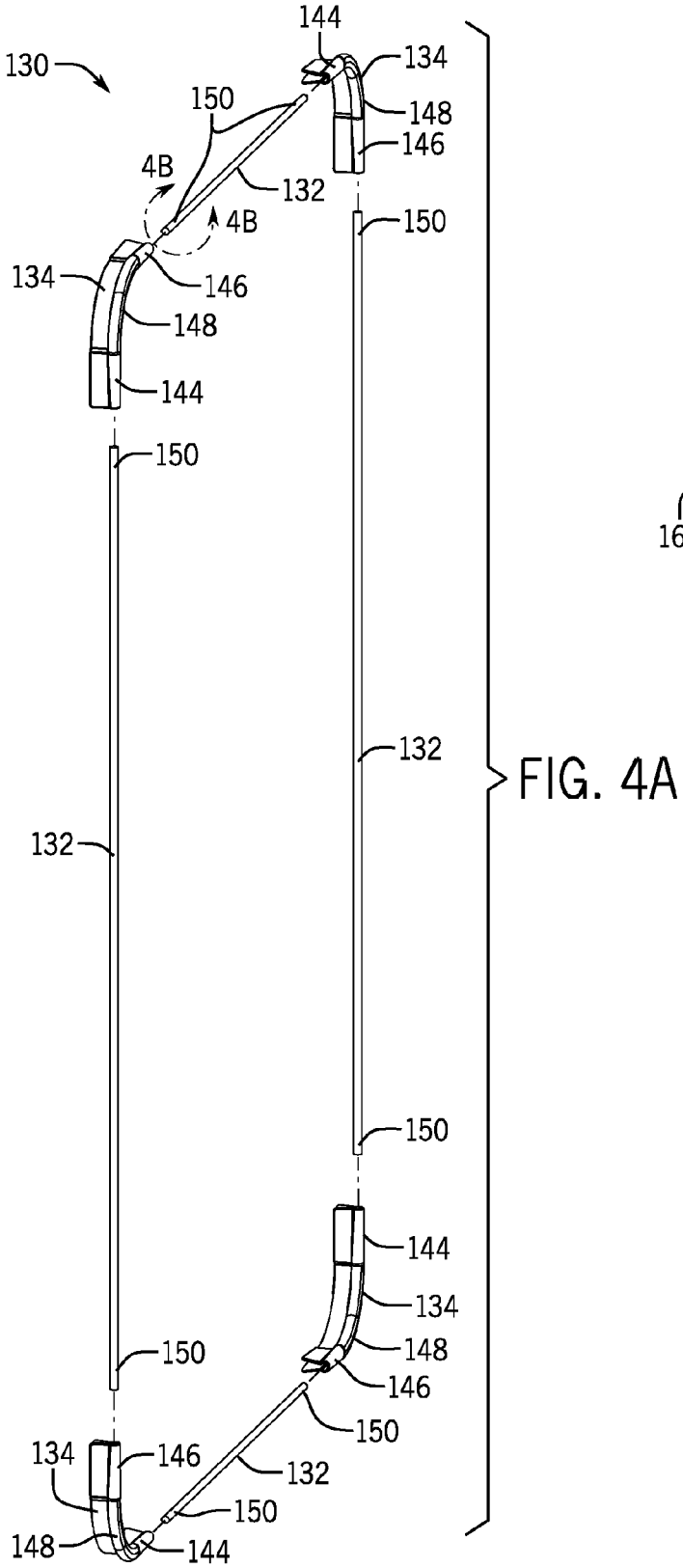
FIG. 4A is a schematic exploded view of an external frame of a luggage article shown in FIG. 1.
Figure 4B:
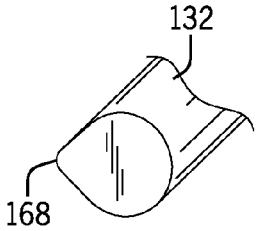
FIG. 4B is a schematic detail view of a rod shown in FIG. 4A of a luggage article shown in FIG. 1 taken along the line 4B-4B shown in FIG. 4A.
Figure 4C:
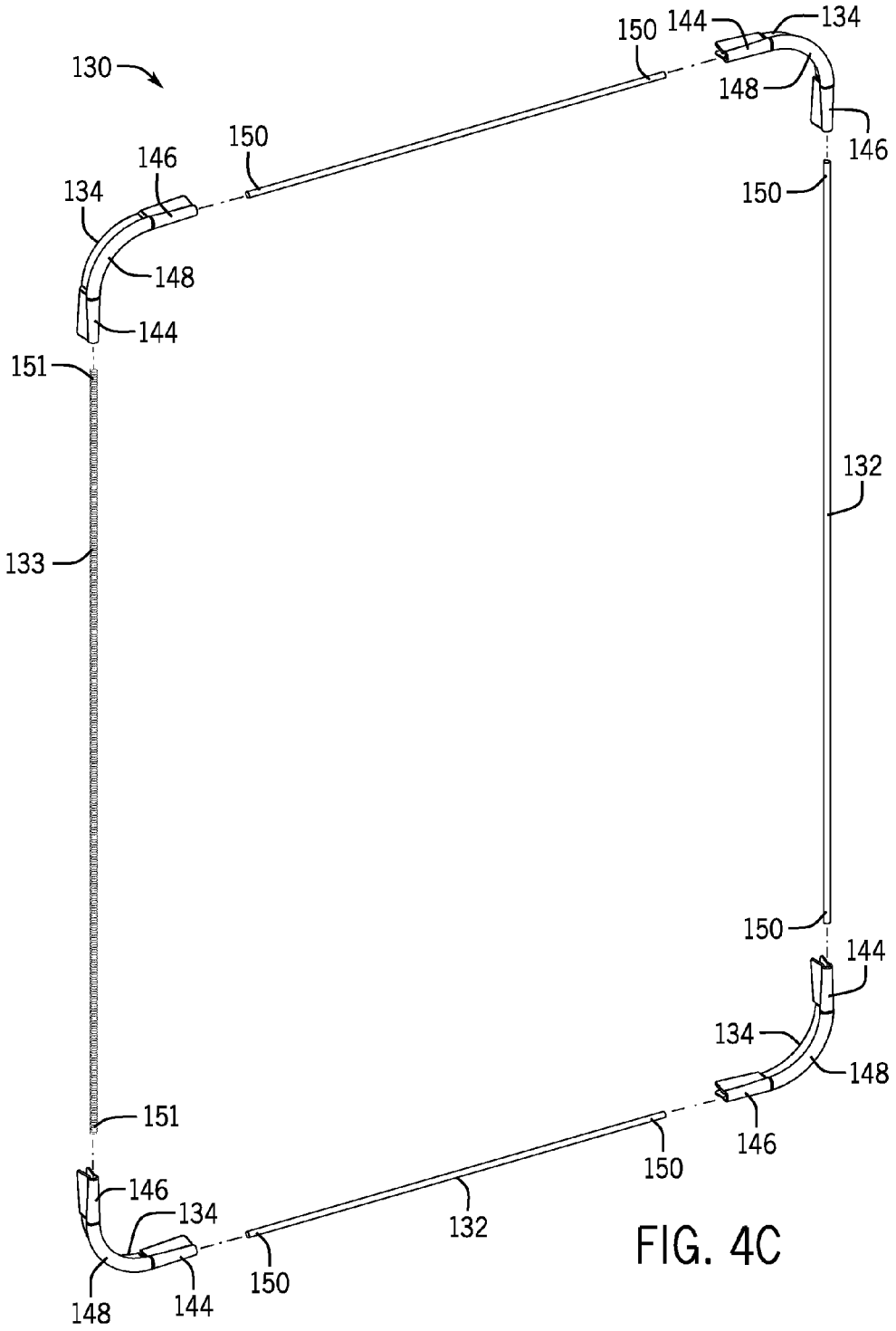
FIG. 4C is a schematic detail view of a coil spring member shown in an alternative embodiment of an external frame of FIG. 4A of a luggage article shown in FIG. 1.

Referring to FIG. 4C, in another arrangement, one or more frames 130 may include a rod formed by a coil spring member 133 in place of one or more elongated members or rods 132. The coil spring member 133 may include an end portion 151 for receipt in an end region 144,146 of a corner piece 134. A separate sleeve 136 may be positioned around the coil spring member 133 and may be positioned at least partially external to the outer cover 105. Each sleeve 136 may extend the length of the associated coil spring member 133 and is folded over the coil spring member 133 to form longitudinally-extending edge portions 138 that extend from opposing sides of coil spring member 133 as described above with respect to a rod 132.

In a frame 130 having a coil spring member 133 and a plurality of rods 132, the coil spring member 133 provides added flexibility such that a corner piece 134 connecting a rod 132 and a coil spring member 133 will bend more easily and, for example, allow access to a panel pocket opening. While FIG. 4C illustrates only a single coil spring member 133, a coil spring member may replace additional rods 132 such that the frame 130 includes two coil spring members 133 and two rods 132, or three coil spring members 133 and one rod 132, or all rods.

Referring to FIG. 3, the framed panels 102,106,108 may be assembled individually prior to attachment to the other walls 104,110,112 of the luggage article 100. An assembly method may include placing the rods 132 in the sleeves 136, fitting the corner pieces 134 to the rods 132 and sleeves 136 to form the frames 130, attaching the panels 102,106,108 to a portion of the sleeves 136 to form framed panels 102,106, 108, and attaching the framed panels to the other walls 104,110,112 or wrap of the luggage article 100 using another portion of the sleeves 136 along a seam of the luggage article. This method may be contrasted with conventional arrangements in which the fabric panels of the luggage article are all stitched completely along their seams and then an internal frame is inserted into the luggage article, or where wire loops are used which may distort and deform during assembly. The framed panels 102,106,108 may be advantageously formed 'square' and stitched in such a 'square' configuration more easily than conventional arrangements since the rods 132 and corner pieces 134 may be assembled prior to attachment to the fabric and may hold the fabric in place once attached to the fabric. It is also easier to ensure the frames 130 are 'square' and remain 'square' as this is dictated by the corner pieces 134 and length of the rods 132. The 'squarer' frame may make it easier to form a 'square' final luggage article 100.

Referring to FIGS. 1-3, the corner pieces 134 and sleeves 136 may be attached to the outer cover 105 along a seam 140 of the luggage article 100. The corner pieces 134 may be attached to the luggage article 100 at corner regions 142 of one of the walls 102,104,106,108,110,112. The corner pieces 134 may be arcuate or curved and may form ninety-degree elbows for a rectangular configuration or other angles for other configurations. The corner pieces 134 may be exposed and visible externally of the outer cover 105 to provide corner protection or reinforcement to the luggage article 100. The corner pieces 134 may be rigid such that once the corner pieces 134 are formed, such as by moulding, the corner pieces 134 may set the shape of the frames 130.

Figure 5:
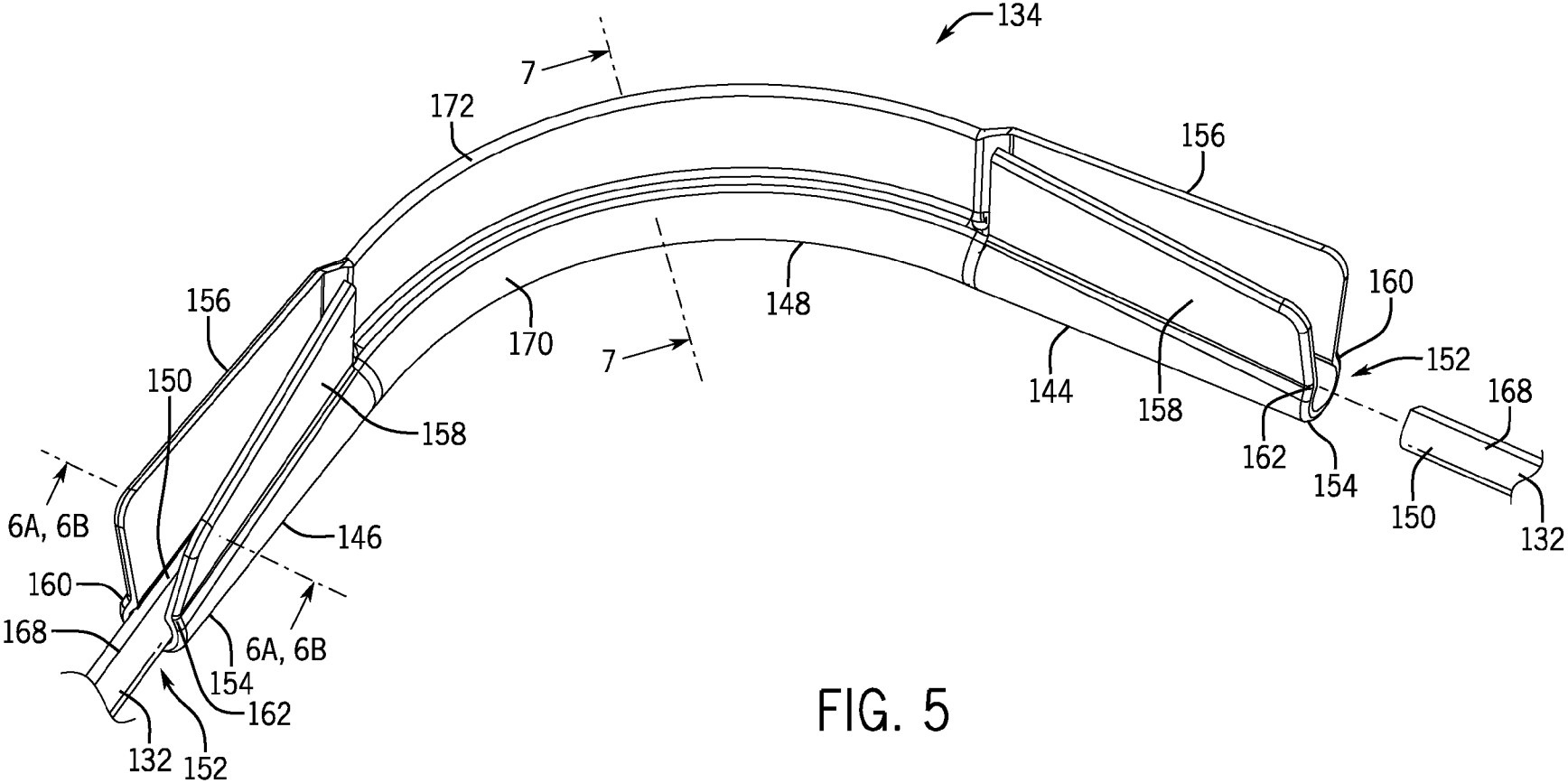
FIG. 5 is a schematic perspective view of a corner piece shown in FIG. 4A of a luggage article shown in FIG. 1 with a fragmentary rod inserted into one end of the corner piece and a fragmentary rod exploded from a second end of the corner piece.

Referring to FIGS. 4A and 5, the corner pieces 134 each may include an intermediate region 148 and opposing end regions 144,146 extending from opposing ends of the intermediate region 148. The intermediate region 148 may extend in an arcuate or curved path between the end regions 144,146. The intermediate region 148 may extend along a curve such that the end regions 144,146 are aligned along adjacent edges of a respective wall 102,104,106,108,110, 112. For instance, the end regions 144,146 may be oriented orthogonal or substantially orthogonal to one another for attachment to a corner of a respective rectangular wall. The end regions 144,146 may be identical to one another and may receive end portions 150, 151 of rods 132 or coil spring member 133 extending along adjacent sides of a respective wall 102,104,106,108,110,112 of the luggage article 100. Each end region 144,146 may define a constrictable receiving cavity 152 (see FIG. 5) adapted to receive and retain an end portion 150, 151 of a respective pultrusion rod 132 or coil spring member 133.

Figure 6A:
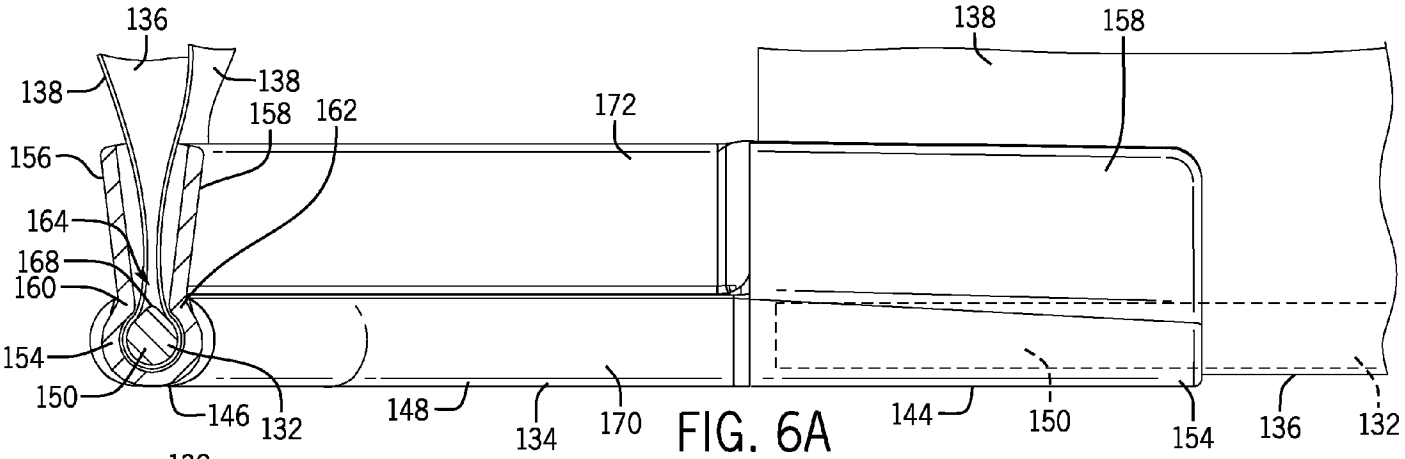
FIG. 6A is a schematic cross-section view of a corner piece shown in FIG. 4A of a luggage article shown in FIG. 1 taken along the line 6A-6A shown in FIG. 5.
Figure 6B:
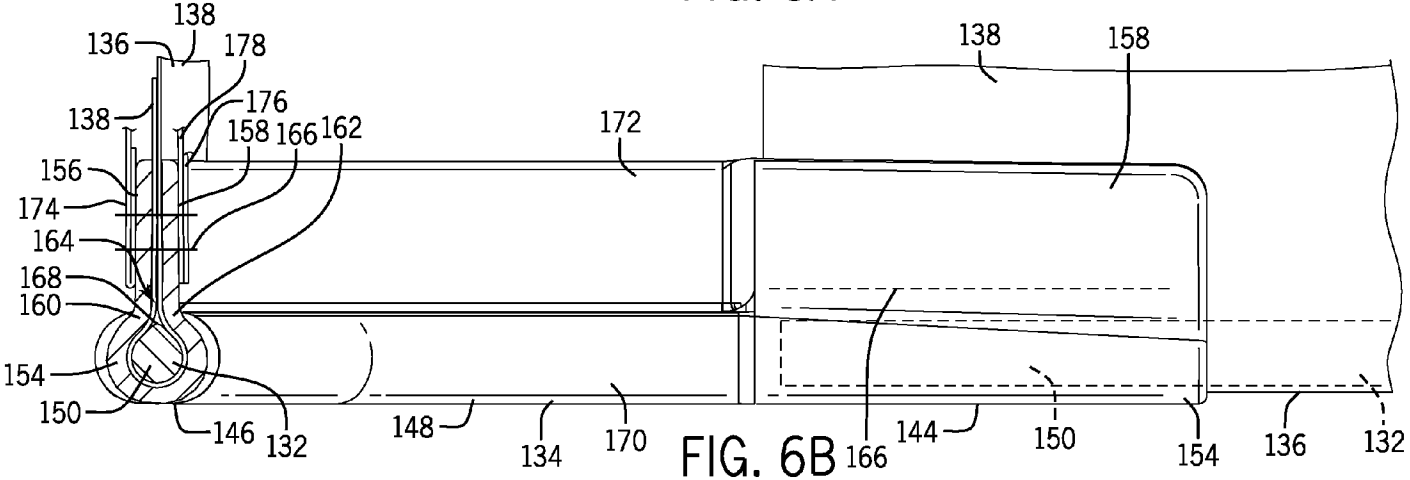
FIG. 6B is a schematic cross-section view of a corner piece shown in FIG. 4A of a luggage article shown in FIG. 1 taken along the line 6B-6B shown in FIG. 5 with tabs of the corner piece stitched to one another.

Referring to FIGS. 5-6B, each end region 144,146 may include a boss 154 that defines the receiving cavity 152, which may be referred to as an elongated, internal recess that extends along a length of the boss 154. The boss 154 may have a closed end adjacent the intermediate region 148 and an opposite open end. Opposing, longitudinally-extending edges 160,162 of the boss 154 may define a gap or slit 164 extending along the length of the boss 154 and opening into the receiving cavity 152 (see FIGS. 6A and 6B). The slit 164 may have a width dimension less than a diameter of the receiving cavity 152.

Referring to FIGS. 5-6B, each end region 144,146 may include a pair of tabs 156,158 extending radially outwardly from and attached to the opposing edges 160,162 of the boss 154. The tabs 156,158 may be angularly-spaced apart from one another such that movement of the tabs 156,158 towards one another narrows the slit 164 and radially constricts the boss 154, thereby constricting the size of the receiving cavity 152 (see FIGS. 6A and 6B in sequence). The tabs 156,158 may be referred to as flaps or wings.

Referring to FIG. 6A, when the tabs 156,158 are spatially separated from one another, the receiving cavity 152 defined by the boss 154 may permit the position of a pultrusion rod 132 and associated sleeve 136 to be adjusted axially within the boss 154. Referring to FIG. 6B, once the respective rod 132 and sleeve 136 are inserted fully into the receiving cavity 152, the tabs 156,158 may be moved toward one another to radially constrict the boss 154 about the respective rod 132 and sleeve 136. When the tabs 156,158 are moved toward one another, the tabs may move the opposing edges 160,162 of the boss 154 toward one another, thereby reducing the width of the slit 164 and the size of the receiving cavity 152 by radially constricting the boss 154, which may apply a radially-compressive force to the sleeve 136 and the end portion 150 of the rod 132 to secure the rod 132 within the receiving cavity 152 of the corner piece 134. The tabs 156,158 may be attached to one another by stitching 166, adhesive, or other attachment means. In some implementations, the tabs 156,158 are attached to one another with stitching that also attaches the respective panel or wall to the luggage article 100. This is described in more detail below.

Referring to FIGS. 4B-6B, the pultrusion rods 132 each may have a non-circular cross-section to prevent or substantially prevent rotation of the rods 132 relative to the corner pieces 134. For instance, the rods 132 each may have a teardrop-shaped cross-section. With reference to FIGS. 6A and 6B, the rods 132 each may have a radially-projecting, longitudinally-extending point or ridge 168 that may be positioned between the tabs 156,158 to prevent or substantially prevent rotation of the rods 132 about their longitudinal axes relative to the corner pieces 134. In some implementations, the rods 132 may have a circular cross-section and the boss 154 may apply a sufficient radially-compressive force to the end portions 150 of the rods 132 to prevent or substantially prevent rotation of the rods 132 about their longitudinal axes relative to the corner pieces 134. By avoiding rotation of the rods 132 relative to the corner pieces 134, advantageously the frame 130 may be twisted easily during assembly and operation.

Figure 7:
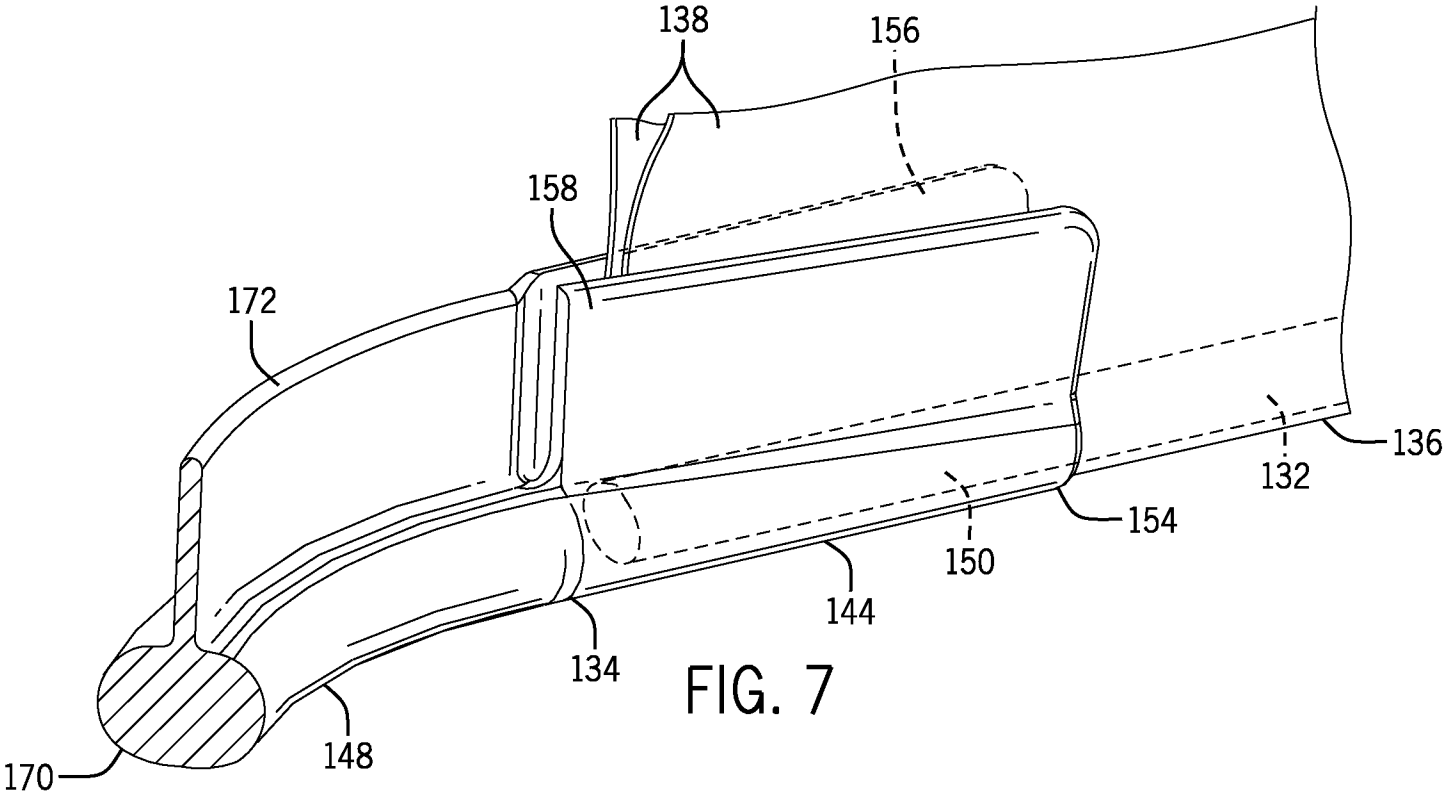
FIG. 7 is a schematic cross-section view of a corner piece shown in FIG. 4A of a luggage article shown in FIG. 1 taken along the line 7-7 shown in FIG. 5.
Figure 8:
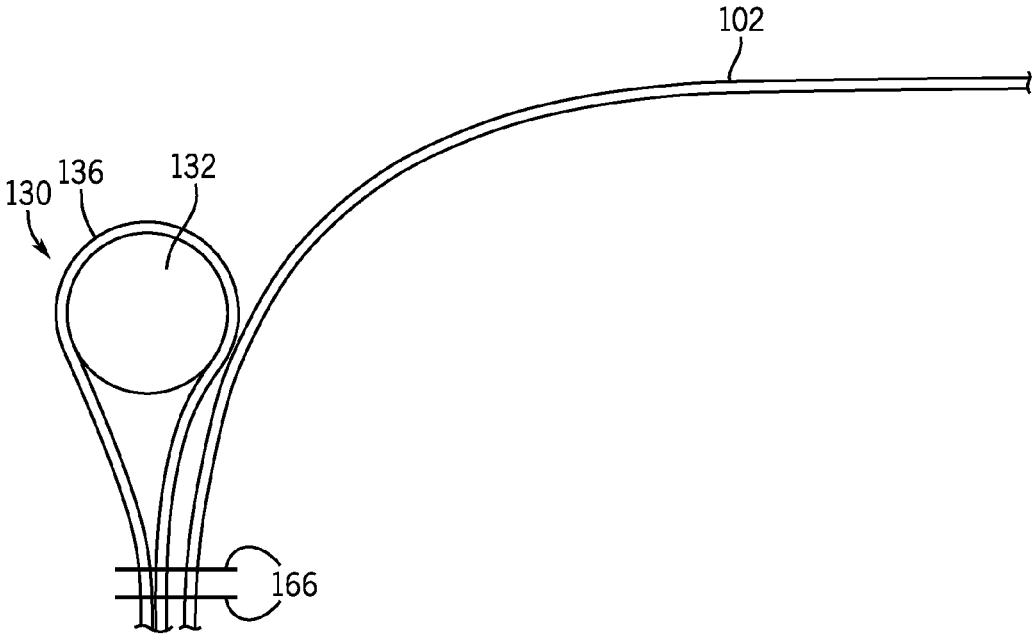
FIG. 8 is a schematic view of an external frame attached to a wall of the luggage article.
Figure 9:
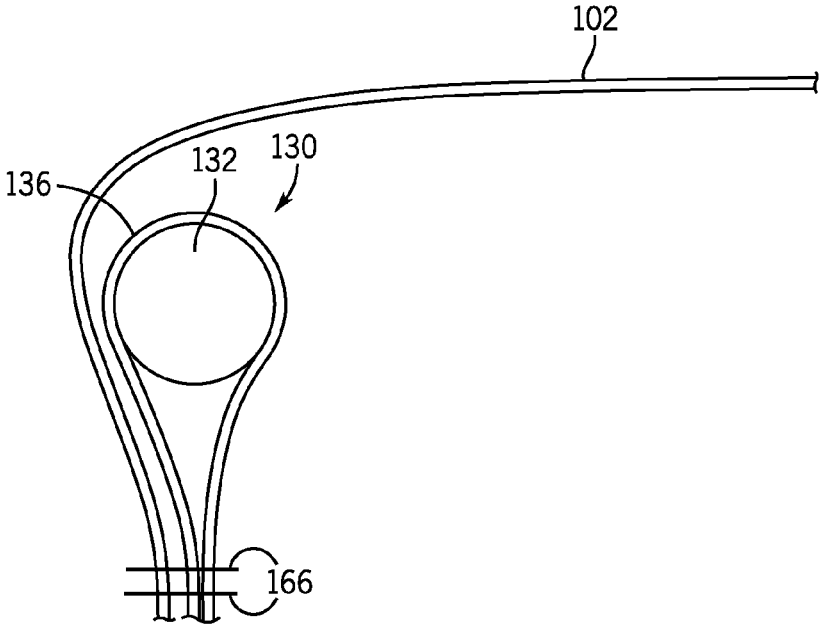
FIG. 9 is a schematic view of an internal frame attached to a wall of a luggage article.

Referring to FIG. 7, the intermediate region 148 of the corner pieces 134 may have a solid cross-section. The intermediate region 148 may include a cylindrical or substantially-cylindrical body 170 and a single fin 172 projecting radially outwardly from and extending longitudinally along the cylindrical body 170. The fin 172 may be continuous with one tab 156 of each end region 144,146, and the other tab 158 of each end region 144,146 may be discrete from the fin 172 to facilitate movement of the discrete tab 158 relative to the continuous tab 156 during movement of the tabs 156,158 toward one another to secure the pultrusion rods 132 to the corner pieces 134. The tabs 156,158 and the fin 172 of each corner piece 134 may be aligned with one another for insertion into a seam 140 of the luggage article 100 for securing the corner piece 134 to the article. The tabs 156,158 and the fin 172 may assist in keeping and locating the sleeves 136 in a certain orientation and position for attachment to other panels or walls of the luggage article 100. For example, the tabs 156,158 and the fin 172 may hold the sleeves 136 at ninety degrees or substantially ninety degrees relative to the plane of the framed panel or wall 102. This configuration may facilitate orientation of the framed panel at ninety degrees or substantially ninety degrees relative to the other panels to which it is connected during assembly. FIG. 8 shows a schematic of an external frame 130 with sleeves 136 oriented at ninety degrees or substantially ninety degrees relative to a front panel or wall 102 of a luggage article 100. FIG. 9 shows a schematic of an internal frame 130 with sleeves 136 oriented at ninety degrees or substantially ninety degrees relative to a front panel or wall 102 of a luggage article 100. In some examples, the frame 130 may include sleeves 136 oriented parallel to a respective panel or wall of the luggage article 100.

Referring to FIG. 4A, the external frame 130 may be pre-assembled prior to attachment to the luggage article 100. The rods 132 and the sleeves 136 may be joined together by the corner pieces 134 to form a solid, lightweight frame construction. Referring to FIGS. 3, 4A, and 5, to attach the frame 130 to a respective wall of the luggage article 100, the edge portions 138 of the sleeves 136, the radially-extending tabs 156,158 of the end regions 144,146 of the corner pieces 134, and the fin 172 of the intermediate region 148 of the corner pieces 134 may be attached, such as by stitching, to a periphery of a respective wall 102,104,106,108,110,112. Once attached to the respective wall, the frame 130 and respective wall may be attached to other walls of the luggage article 100 along one or more seams 140 of the outer cover 105 of the luggage article 100. For example, the corner pieces 134 and the sleeves 136 may extend into one or more seams 140 of the luggage article 100 and may be attached to the luggage article 100 with seam stitching. Specifically, the radially-extending tabs 156,158 and fin 172 of the corner pieces 134 (see FIG. 5) may extend into and may be attached along a seam 140 of the outer cover 105 such that the tabs 156,158 and the fin 172 of each corner piece 134 are concealed or hidden within the seam 140 of the outer cover 105. Referring to FIGS. 3 and 6B, the tabs 156, 158 and the fin 172 may be sandwiched between an outer fabric layer 174 and an inner fabric liner 176 and attached together with seam stitching 166. A stiffening plate 178, such as a polypropylene board, may be positioned along at least one side of the tabs 156, 158 and the fin 172 to stiffen the associated wall.

Referring to FIGS. 3, 4A, 5, 6A, and 6B, the bosses 154 of the end regions 144,146 of the corner pieces 134 and the body 170 of the intermediate region 148 of the corner pieces 134 may be positioned external to and exposed outside of the outer cover 105 to provide corner protection to the luggage article 100. The rods 132 may be positioned external to the outer cover 105 and may extend along the one or more seams 140 of the outer cover 105. The rods 132 may be concealed or hidden from view by the sleeves 136 and the bosses 154 of the end regions 144,146 of the corner pieces 134.

Relative to conventional luggage frames, the frame of the present disclosure generally results in better memory and elasticity with reduced weight. The frame generally may be easier to twist than conventional luggage frames with reduced permanent deformation, facilitating handling of individual panels or walls of a luggage article and assembly of the individual walls into a luggage article. The frame, in this configuration, may be positioned external to the outer cover of the luggage article, resulting in more internal space for one's belongings.

The luggage frame of the present disclosure has broad application. For instance, the frame may be formed in various shapes to provide support to variously-shaped panels or walls of a luggage article. The frame may be fitted to a panel during stitching, rather than afterwards. The luggage frame of the present disclosure may be used with soft-sided luggage articles or hybrid-type luggage articles. Although described as an external, visible frame, the frame may be an internal, hidden frame positioned interior of the outer cover of the luggage article (see FIG. 9).

The frame may be formed from various materials. The rods may be formed of metallic and/or non-metallic materials. The rods may be formed using an extrusion, pultrusion, or other moulding process. In some examples, the rods may be formed of a polymer and reinforcing fibers moulded together during a pultrusion moulding process. Example polymers include, but are not limited to, polyester, vinyl ester, and epoxy. Example reinforcing fibers include, but are not limited to, glass, carbon fiber, and nylon. In some examples, the rods may be wood, metal, or other suitable materials. The corner pieces may be formed of a plastic material and may be scuff resistant.

The apparatuses and associated methods in accordance with the present disclosure have been described with reference to particular embodiments thereof in order to illustrate the principles of operation. The above description is thus by way of illustration and not by way of limitation. In methodologies directly or indirectly set forth herein, various steps and operations are described in one possible order of operation, but those skilled in the art will recognize that the steps and operations may be rearranged, replaced, or eliminated without necessarily departing from the spirit and scope of the disclosed embodiments.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use of the invention unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

What is claimed is:

1. A luggage article comprising:

at least one panel; and the at least one panel attached to other walls to form the luggage article, wherein the at least one panel is framed by at least two rods, each rod having a sleeve positioned around and extending along a length of a respective rod, and corner pieces fitted thereon to form a peripheral frame that extends around and supports the periphery of a lamina, and at least a portion of the sleeve attached to the lamina to thereby form a framed panel that is attached to other walls to form the luggage article, and wherein each corner piece includes at least one end region defining a receiving cavity adapted to receive an end portion of a respective rod, and an arcuate intermediate region including a fin extending therefrom.

2. A luggage article as claimed in claim 1 wherein the corner pieces are exposed and provide corner reinforcement to the luggage article; and the rods are positioned external to the walls of the luggage article.

3. A luggage article as claimed in claim 1 wherein the at least one end region defines a constrictable receiving cavity adapted to receive an end portion of a respective rod.

4. A luggage article as claimed in claim 3 wherein the at least one end region includes a boss that defines the receiving cavity and includes a pair of radially-extending, angularly-spaced tabs attached to opposing, circumferentially-separated edges of the boss.

5. A luggage article as claimed in claim 4 wherein the respective rod has a radially-projecting, longitudinally-extending ridge that extends between the radially-extending tabs to prevent rotation of the respective rod relative to the corner pieces.

6. A luggage article as claimed in claim 4 wherein the radially-extending tabs extend into and are attached along one or more seams of the luggage article.

7. A luggage article as claimed in claim 4 wherein the arcuate, intermediate region of the corner pieces have a solid cross-section.

8. A luggage article as claimed in claim 7 wherein the fin of the intermediate region is aligned with the tabs of the at least one end region.

9. A luggage article as claimed in claim 1 wherein the sleeves are exposed externally of the luggage article.

10. A luggage article as claimed in claim 9 wherein the sleeve includes longitudinally-extending edge portions that extend into and are attached along one or more seams of the luggage article.

11. A luggage article as claimed in claim 1 wherein the at least one panel comprises a pair of side walls of the luggage article.

12. A luggage article as claimed in claim 1 wherein the at least one panel comprises a front wall of the luggage article.

13. A luggage article as claimed in claim 1 wherein the rods and corner pieces extend in a closed loop around the periphery of the at least one panel and preferably form a substantially rectangular shape.

14. A luggage article as claimed in claim 1 wherein the rods and corner pieces are attached to the at least one panel and the at least one panel is attached to the other walls of the luggage article.

15. A luggage article as claimed in claim 1 wherein the at least one panel is framed by a coil spring member positioned in a sleeve and attached to the lamina to secure the frame to the lamina.

* * * * *